US007347187B2

(12) United States Patent
Perini

(10) Patent No.: US 7,347,187 B2
(45) Date of Patent: Mar. 25, 2008

(54) INTERNAL COMBUSTION ENGINE, AN ENGINE HEAD AND A FUEL DISTRIBUTION LINE

(75) Inventor: Rinaldo Perini, São Paulo (BR)

(73) Assignee: International Industria Automotiva Da America Do Sul Ltda., Warrenville, IL (US)

( * ) Notice: Subject to any disclaimer, the term of this patent is extended or adjusted under 35 U.S.C. 154(b) by 65 days.

(21) Appl. No.: 10/595,438

(22) PCT Filed: Oct. 15, 2004

(86) PCT No.: PCT/BR2004/000200

§ 371 (c)(1),
(2), (4) Date: Apr. 19, 2006

(87) PCT Pub. No.: WO2005/038233

PCT Pub. Date: Apr. 28, 2005

(65) Prior Publication Data

US 2006/0288985 A1 Dec. 28, 2006

(30) Foreign Application Priority Data

Oct. 21, 2003 (BR) ..... 0304633

(51) Int. Cl.
*F02M 69/46* (2006.01)
*F02M 55/02* (2006.01)

(52) U.S. Cl. ..... 123/456; 123/468; 123/469

(58) Field of Classification Search ..... 123/468, 123/469, 456, 195 C
See application file for complete search history.

(56) References Cited

U.S. PATENT DOCUMENTS 4,384,557 A * 5/1983 Johnson ..... 123/198 D
4,445,713 A * 5/1984 Bruning ..... 285/14
5,697,344 A * 12/1997 Ikari ..... 123/468
5,950,602 A * 9/1999 Shinohara ..... 123/509
6,237,571 B1 * 5/2001 Harrison ..... 123/469
6,394,071 B2 * 5/2002 Nitta et al. ..... 123/456

* cited by examiner

*Primary Examiner*—Thomas Moulis
(74) *Attorney, Agent, or Firm*—Jeffrey P. Calfa; Gerald W. Askew

(57) ABSTRACT

It is described an internal combustion engine, preferably an engine that operates according to the Diesel cycle, comprising at least one engine head (1) with a valve cover (2) and at least one fuel distribution line (4), associated with the engine head (1) through at least one through aperture (8) located in the valve cover (2). The present invention further relates to an engine head (1), particularly for use in an internal combustion engine, and to a fuel distribution line (4).

5 Claims, 3 Drawing Sheets

INTERNAL COMBUSTION ENGINE, AN ENGINE HEAD AND A FUEL DISTRIBUTION LINE

The present invention relates to an internal combustion engine provided with a fuel distribution line directly associated to the engine head, instead of being associated to the valve cover, thereby bring about lesser incidence of vibration on this line, which increases the reliability of the engine, since this reduces the occurrence of failures caused by this vibration. Additionally the invention relates to an engine head for use on the above-mentioned engine and to a fuel distribution line.

DESCRIPTION OF THE PRIOR ART

Conventionally, Otto-cycle 4-stroke engines were equipped with a carburetion system and Diesel-cycle 4-stroke engines were equipped with conventional rotary injection pumps.

In the case Otto-cycle engines, the air sucked by the engine pistons went through the carburetor and, upon passing through the venturi, dragged a determined about of fuel, by difference in pressure. Then, this air-fuel mixture was admitted by the engine. Therefore, the fuel feeding comprised a pump sent fuel to the carburetor, under low pressure, usually by means of flexible rubber hoses.

With the passage of time, the carburetors were replaced by mechanical fuel injection systems, which effected the injection of fuel into the intake manifold, thereby bring about better control of the fuel amount injected for each engine-functioning situation. This system was improved with the appearance of electronic injection systems, wherein a central processing unit (commonly known as electronic injection module) monitors a number of engine-functioning parameters, aiming at the injection of the ideal amount of fuel for each situation. In these systems, the opening (s) of the fuel injectors is carried out by means of electric signals sent by the processing central.

However, whatever is the fuel injection system used, there is always a pressurized fuel line with high pressure, so that, when the fuel injector opens, the pressurized fuel gushes into the intake manifold. As a rule, there is a single fuel line, to which all the fuel injectors are linked.

Since this fuel line works with a high pressure, it is fundamental that no breakage of the line or element connection may occur, under pain of imminent risk of fire.

Since the fuel should be injected into the intake manifold, usually the fuel line fixed to it is rigidly linked to the engine head, so that there will not be any excessive vibrations produced by the engine and, in this way, the fuel line, will not receive a high stress load in the form of vibrations.

However, with a view to obtain better efficiency in the functioning of Otto-cycle engines, especially with regard to the specific consumption and the reduction of pollutant emission, the designers have tried to develop engines where the fuel is not injected into the intake manifold, but rather directly into the combustion chamber(s), during the intake phase of its functioning cycle.

With these engines, which are known as direct-injection engines, the positioning of the injector (s) at the engine head sometimes requires that the fuel feeding should be fixed at the valve cover, which brings drawbacks, which will be described in greater detail later.

Conventional Diesel engines, on the other hand, had a rotary injection pump, actuated by the crankshaft synchronically with the piston movement, so that the fuel was injected into each cylinder, at the moment when the air compression inside was maximum, or else short before this moment. This solution had individual lines for each fuel injector, which were located, as a rule, at the side of the engine head(s), due to the arrangement of the valves and the shape of the combustion chamber.

However, also for the purpose of obtaining better functioning efficiency, mainly an increase in the power and operational smoothness, and reduction in the admission of particulate material, Diesel engines received successive improvements, as for example, the use of multivalve heads (with three or four valves per cylinder) and evolved injection systems comprising a single pressurized fuel line, linked to the injectors, which then began to be commanded electronically by means of a processing central (or electronic injection module). These injection systems of the new Diesel engines were now much more similar to those used by the Otto-cycle engines.

Additionally, due to the improvement of the design in combustion chambers of these new engines, and above all with the utilization of multivalve heads, the injectors ends up being positioned at the central part of the combustion chamber and, in this way, the fuel line has to be fixed to the valve cover of the engine.

Regardless of the type of engine in question, be it the Otto cycle or the Diesel cycle, the valve cover is a component fixed to the engine head (usually by means of screws) and, for this reason, it ends up excessively propagating the vibrations produced by the engine, passing them on to the fuel line. This problem is more serious on Diesel engines, since due to the high compression ratios and to the high mass of their internal components, more intense vibrations are generated in comparison with those generated by an Otto-cycle engine.

To make this panorama still worse, the valve covers that were stamped in steel or cast in aluminum are now being replaced by plastic covers with a view to reduce costs and weight. Unfortunately, however, these covers resist less to the vibrations generated by the engine, propagating them in an excessive way and subjecting the fuel lines fixed thereto to a vibration level that may damage them.

With a view to eliminate these drawbacks, mountings were developed for positioning the fuel line on the valve cover, but these components have a limited useful life, and may cause failures that limit the capability of isolating vibrations. So, as these mountings grow old, the fuel line becomes exposed to excessive vibrations, and may be damaged and even cause leakage of fuel, which might cause an accident/fire.

Therefore, until now one had not developed an engine that could enable the positioning of the pressurized fuel line on the valve cover, without having the above-cited drawbacks.

OBJECTIVE OF THE INVENTION

An objective of the present invention is to provide an internal combustion engine provided with means to enable fixation of the pressurized fuel line on the valve cover, thus minimizing exposure to vibrations of the engine propagated by the valve cover.

A second objective of the present invention is to provide an engine head, particularly for use on the above-mentioned internal combustion engine.

A third objective of the present invention is to provide a line for fuel distribution, particularly for use on the above-described internal combustion engine and engine head.

BRIEF DESCRIPTION OF THE INVENTION

The first objective of the present invention is achieved by means of an internal combustion engine comprising at least one engine head, to which at least one valve cover and at least one fuel distribution line are associated, wherein the engine head comprises at least one first association means and the valve cover is provided with at least one through opening, the fuel distribution line being associated to the first engine-head association means through the opening in the valve cover.

The second objective of the present invention is achieved by means of an engine head, particularly for use on an internal combustion engine, comprising at least a first means for association of at least one fuel distribution line.

And finally the third objective of the present invention is achieved by means of a fuel distribution line, particularly used on an internal combustion engine and on an engine head as defined in the two preceding paragraphs, the line comprising a fixation element provided with a first end for association to the engine head.

The present invention has the following advantages, among others:

- possibility of positioning the fuel distribution line on the valve cover, without it receiving much vibration from the engine due to its fixation directly on the engine head. In this way, the reliability of the engine increases by virtue of the decrease in breakages in fixing the line, which may lead to a dangerous leakage of fuel.
- For the same reason, it is possible to use vale covers of a plastic material, which, although excessively propagating the vibrations produced by the engine, have more reduced manufacture cost.
- Possibility of producing an engine with an average production cost and total reliability as far as the fixation of the fuel line is concerned.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
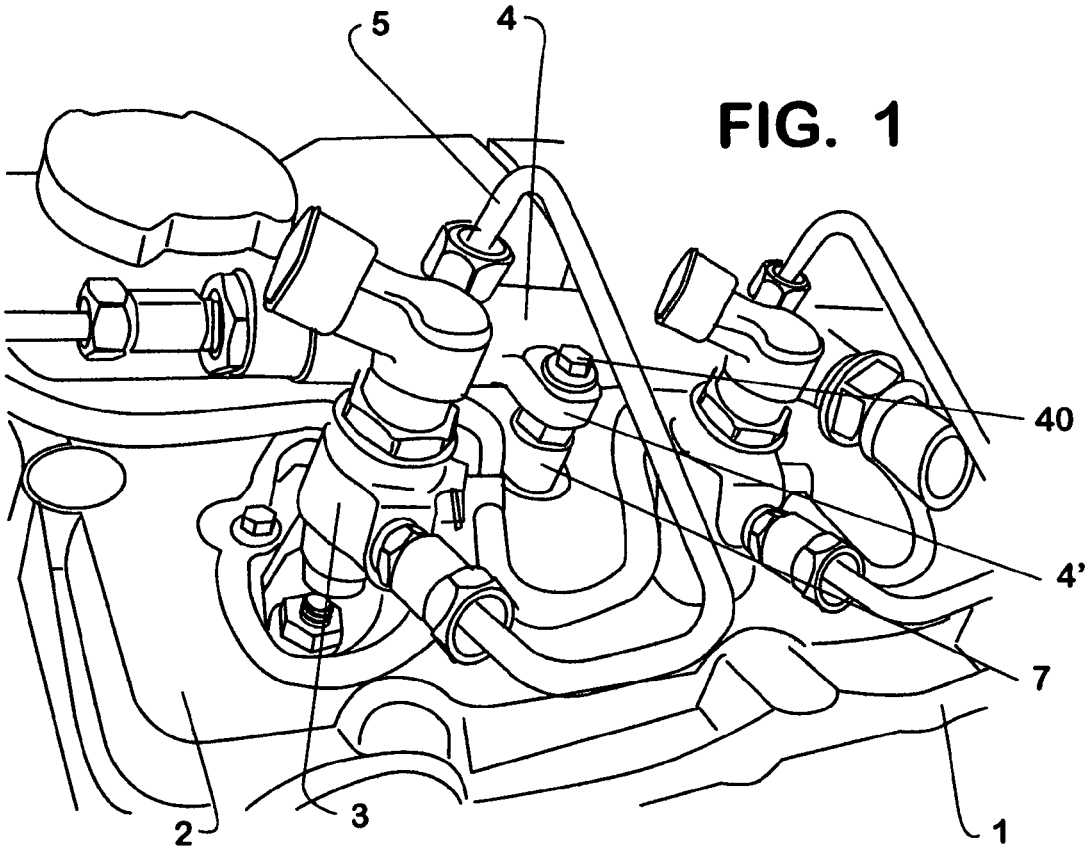
FIG. 1 is a first detail view of the internal combustion engine of the present invention, specifically detailing the valve cover and the pressurized fuel line of the engine.

According to a preferred embodiment and as can be seen from FIG. 1, the internal combustion engine of the present invention (not shown entirely), which is preferably an engine that operates according to the Diesel cycle but may also be an Otto-cycle engine or any other engine, has at least one engine head 1, to which at least one valve cover 2 is associated. Preferably, the engine has only one engine head 1, to which preferably at least one valve cover 2 is associated by means of screws 20. The valve cover has the function of covering the upper cavity of the engine head, which is open for positioning of internal engine components, such as camshaft(s) and/or valves and/or valve rockers, etc (not shown). In order to avoid leakages of lubricating oil, an oil seal gasket is provided between the engine head 1 and the valve cover 2 (not shown).

Further with regard to the preferred embodiment of the engine of the present invention, the engine head 1 is cast in aluminum alloy, while the valve cover 2 is plastic injected. Evidently, however, the engine head 1 may be made from other materials, such as cast iron, while the valve cover may be stamped in steel, aluminum, aluminum alloy, etc.

Figure 2:
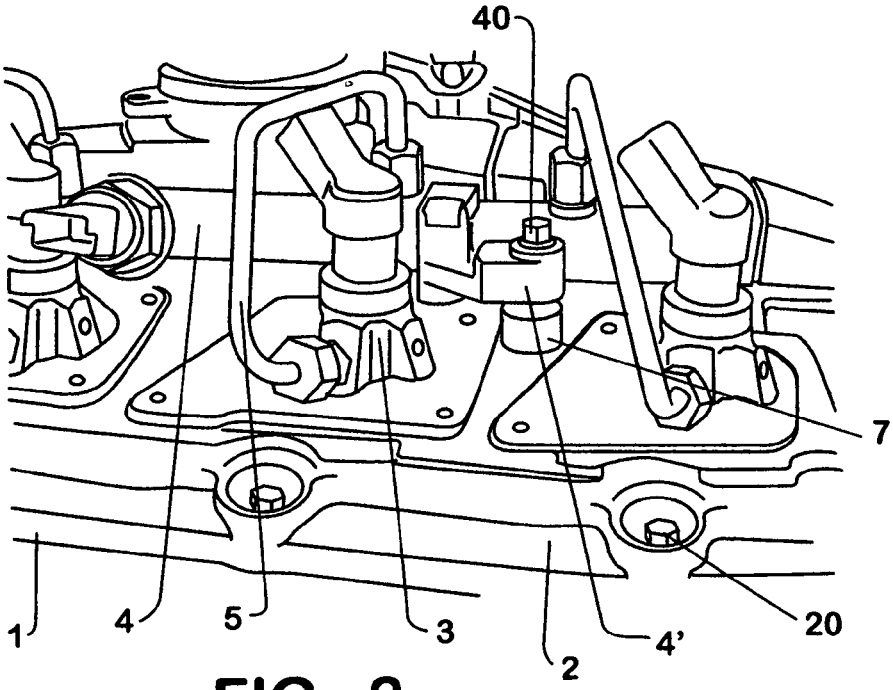
FIG. 2 is a second view of the internal combustion engine of the present invention, specifically detailing the valve cover and the pressurized fuel line of the engine.
Figure 3:
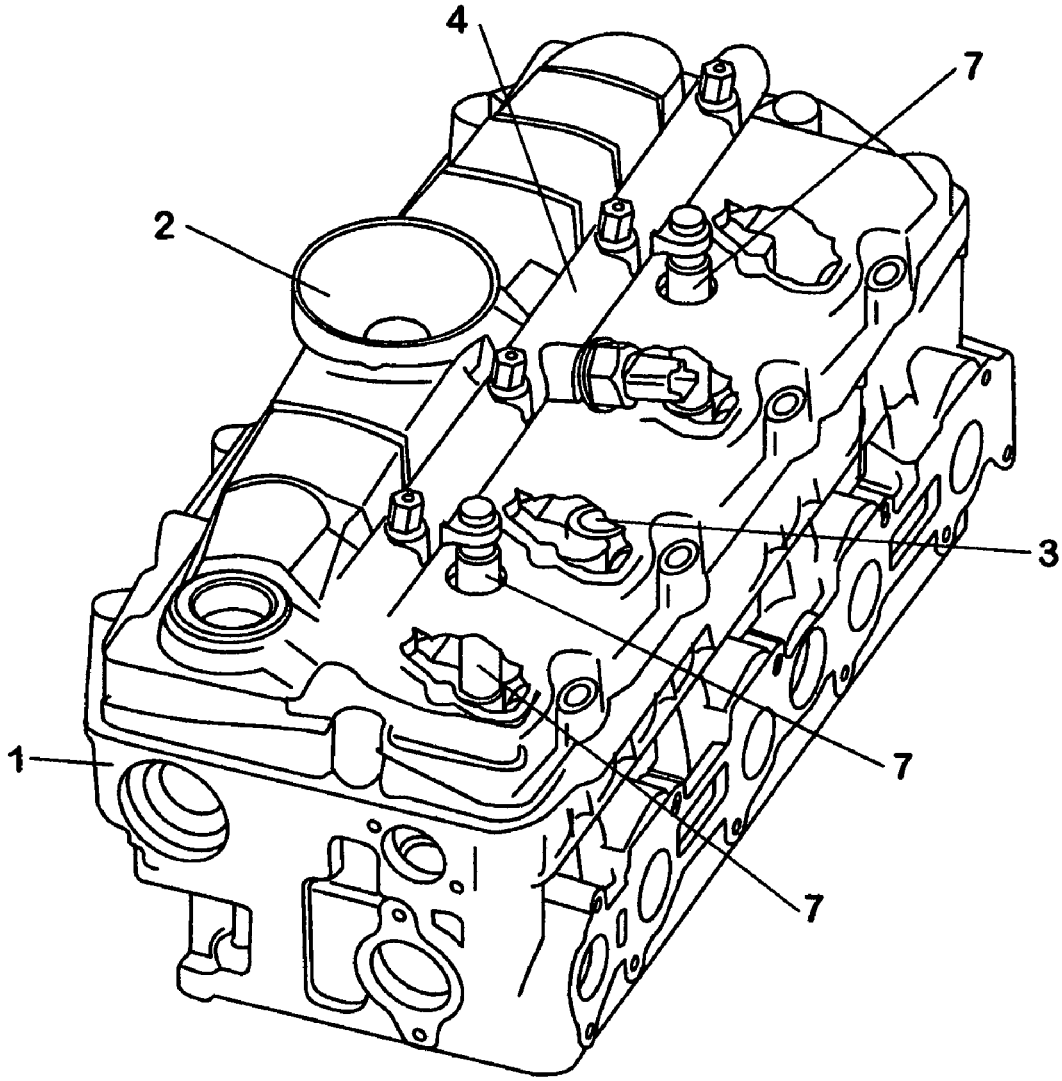
FIG. 3 is a perspective view of the engine head of the present invention, with the valve cover and the pressurized fuel line.
Figure 4:
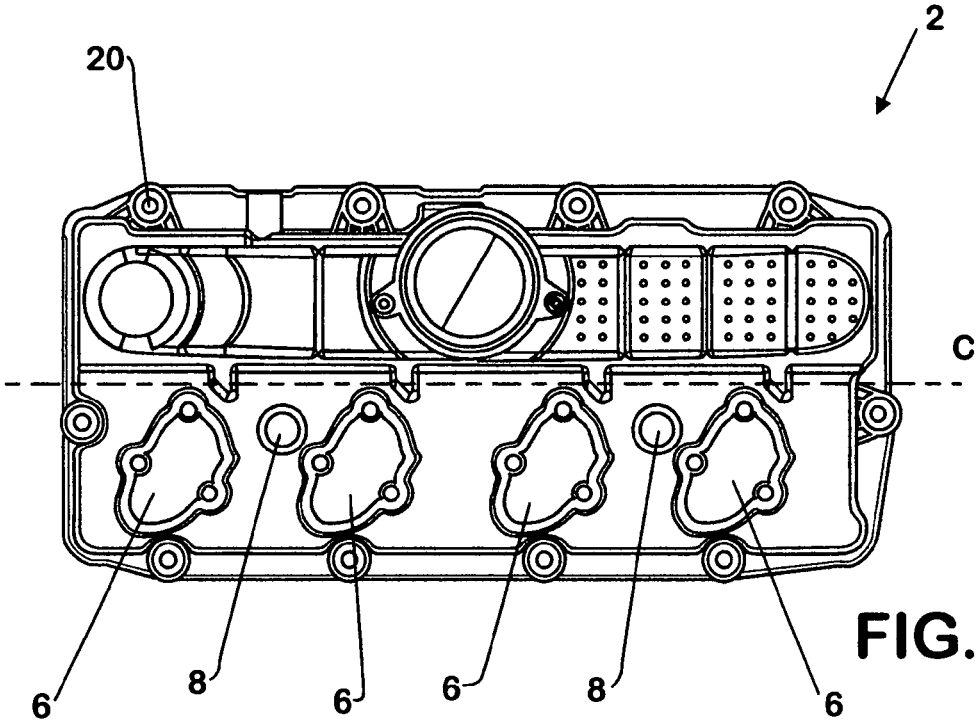
FIG. 4 is a top view of the valve cover of the engine of the present invention.
Figure 5:
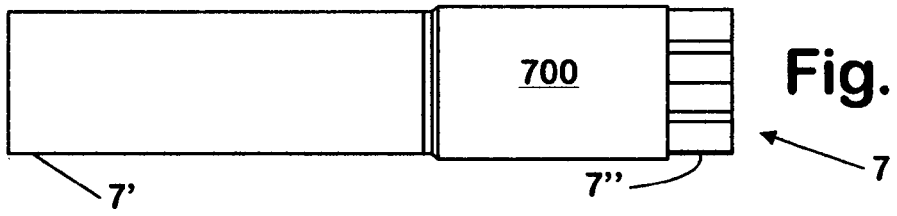
FIG. 5 is a side view of the fixation pin for fixing the pressurized fuel line of the engine of the present invention.
Figure 6:
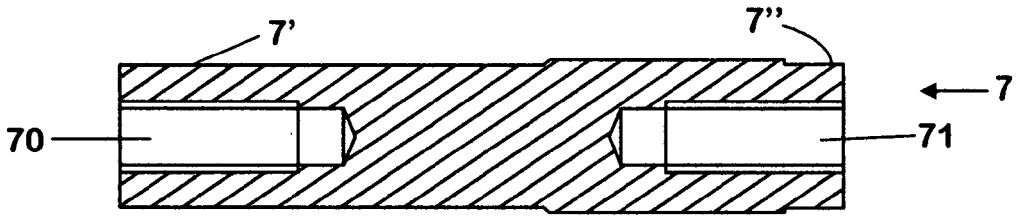
FIG. 6 is a cross-section side view of the pin illustrated in FIG. 5.
Figure 7:
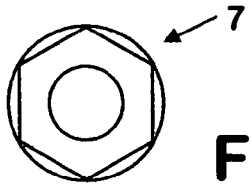
FIG. 7 is a top view of the pin illustrated in FIGS. 5 and 6.

As can be seen, in detail, in FIGS. 1 to 3, the engine head 1 contains four fuel injectors 3 for injecting fuel into the combustion chambers of the engine, a pressurized central line for fuel distribution, also known as pressurized fuel line or more commonly know as "fuel flute", and individual lines 5 that enable the flow of fuel from the pressurized line 4 to the injector 3.

The configuration of the injectors 3, as well as the number thereof, may be any one, since this the is not the focus of the present invention.

The valve cover 2 has a number of apertures, in which the injectors 3 are positioned, since they are directly fixed to the engine head 1 because their injection end (not shown) is inside the combustion chambers. The openings for positioning the injectors are designated with reference number 6. Preferably, the injectors 3 are positioned in a substantially central portion of the combustion chambers (not shown), whereby the apertures 6 are located substantially adjacent the longitudinal center line C of the valve cover 2.

In order to prevent leakage of oil, each aperture 6 is provided with an oil seal gasket, such as a ring made of a polymeric or other material (not shown).

The pressurized fuel line 4 is preferably made from carbon steel, but it may be made of any necessary or desirable material.

Unlike the engines of the prior art (which were explained in detail before), the engine of the present Invention has a pressurized fuel line 4 directly associated to the engine head 1, rather than to the valve cover 2.

Due to the positioning of the injectors 3, the pressurized fuel line 4 should be located over the valve cover 2; otherwise, the individual lines 5 that make the connection between the pressurized line 4 and each injector 3 would be too long, increasing the load presented by the fuel that flows inside it, in addition to the propensity for defects, leakages, ruptures, increase in manufacture costs of the engine, etc.

In view of the positioning of the pressurized fuel line 4 over the valve cover 2, the fixation thereof directly to the engine head 1 is achieved by means of at least one fixation element 7, preferably in the form of a fixation pin 7, the first end of which is associated to the engine head 1 and the second end is associated to the line 4. By preference, the fixation of the pressurized fuel line 4 is achieved by means of two fixation pins 7, but it is evident that this configuration may vary, as for instance, the use of more than two pins, which may be necessary, for example, on engines having 6 cylinders in line and with a high volumetric displacement, due to their length.

With a view to position the fixation pin 7, the valve cover 2 of the preferred embodiment of the engine of the present invention has two through apertures for positioning the fixation pin 7, which are designated in the drawings with reference number 8. Evidently, the valve cover 2 will have as many though apertures for positioning the pin 8 as there are fixation pins 7 for fixation of the pressurized fuel line 4 in the engine head 1.

In the preferred embodiment of the engine of the present invention, the valve cover 2 has two through apertures 8 located substantially adjacent its longitudinal center line C.

The fixation pin 7 has a first end 7' for association to the engine head 1 and a second opposite end 7" for association to the pressurized fuel line 4.

Preferably, the first end 7' of the fixation pin 7 has a first threaded bore 70 for association by screws to a cylindrical projection having with a thread element (not shown) provided on the engine head 1. In this way, the pin 7 screwed to the cylindrical projection has interesting rigidity characteristics, and will not excessively propagate the vibrations produced by the engine when the latter is functioning.

Speaking more generically, the engine head 1 has a first association means for association to the fixation pin 7 (the cylindrical projection), and the fixation pin 7 has a second association means for association to the engine head 1 (the first threaded bore).

It is imperative that each first association means located on the engine head should correspond to the respective through aperture 8 in the valve cover 2, in order to enable the correct positioning of each fixation pin 7.

In the same way, the second end 7" of the fixation pin 7 has a second threaded bore 71 to enable the association thereof with the pressurized fuel line 4. Preferably, the line 4 has at least one projecting ear 4' or any other equivalent functioning means, provided with a through bore, so that can be fixed against the fixation pin 7 by means of a screw 40 secured to the second bore 71.

Evidently, other ways to associate the fixation pin 7 with the engine head 1 may be used, as for instance, by means of a pin of which the first end 7' is provided with threads and is screwed into a bore in the engine head 1, or any other necessary or desirable constructive arrangement. In the same way, the association of the second end 7" of the fixation pin 7 with the pressurized fuel line 4 may vary, and any functional constructive variation is included in the scope of the accompanying claims. Therefore, the engine head 1 may have other configurations of the first means for associating the fixation pit 7, while the latter may have other configurations of the second means for association to the engine head 1.

An engine head 1 provided with at least one association means for associating a fixation pin is also an invention, as defined in the accompanying set of claims.

In order to prevent leakages of oil from the engine, the valve cover 2 preferably comprises an oil seal gasket at each of the through apertures for positioning the pin 8, such as a ring made of a polymeric or equivalent material (not shown).

Also, in order to prevent leakage of oil, the fixation pin 7 has a diameter larger in the region 700 of intersection with the polymeric seal element existing in the through aperture 8, so that there is a greater pressure on this seal element and, therefore, the protection against leakage of oil through it is maximized. This characteristic, however, is merely optional.

Even though the fixation pin 7 has a cylindrical cross-section, the latter may vary, if necessary or desirable, as well as its dimension. In the same way, the pin 7 may be made of any material, as for example, steel, aluminum or any other.

One may further provide a pressurized fuel line comprising the fixation element (s) 7, with all the above-described and possible variations, a situation in which the pressurized line is an invention whose scope of protection is defined in the accompanying set of claims.

In this case, the pressurized fuel line comprises a fixation element provided with a first end 7' for association with the engine head 1, this first end 7' being provided with an association means in the form of a threaded bore 70.

As advantages, the present invention enables the positioning of the pressurized fuel line 4 over the valve cover 2, without it receiving much vibration caused by the engine due to its fixation directly to the engine head 1. In this way, the reliability of the engine increases by virtue of the decrease in breakages upon fixing the line 4, which may lead to a dangerous leakage of fuel.

For the same reason, one may use valve covers 2 made of plastic, which, although excessively propagating the vibrations produced by the engine, on the one hand, have a more reduced manufacture cost, on the other hand.

Thus, one can produce an engine with an average production cost and with total reliability as far as the fixation or the pressurized fuel line 4 is concerned.

A preferred embodiment having been described, it should be understood that the scope of the present invention embraces other possible variations, being limited only by the contents of the accompanying claims, which include the possible equivalents.

The invention claimed is:

1. An internal combustion engine comprising:

an engine head;

a valve cover covering a top of the engine head to enclose a space cooperatively defined by the engine head and the valve cover;

a main fuel line which is disposed exterior to said space and through which fuel is conveyed to individual fuel injectors mounted on the engine head via respective branch lines from the main fuel line to the fuel injectors;

wherein the main fuel line is secured to the engine head by at least one post that is disposed on the engine head and extends through an aperture in the valve cover to the main fuel line, with the post being sealed to the aperture.

2. An internal combustion engine as set forth in claim 1 wherein the main fuel line is secured to the engine head by two such posts that are spaced apart along a length of the main fuel line, that are disposed on the engine head and extend through respective apertures in the valve cover to the main fuel line, with both posts being sealed to the respective apertures.

3. An internal combustion engine 2 wherein the main fuel line comprises spaced apart projections having respective through-bores, and respective fasteners pass through the respective through-bores and thread into the respective posts to hold the respective projections on the respective posts.

4. An internal combustion engine as set forth in claim 1 wherein the post comprises a threaded hole at an end that screws to a threaded projection on the engine head.

5. An internal combustion engine as set forth in claim 4 wherein the post comprises another threaded hole at an opposite end that provides for the main fuel line to be fastened to the post at that opposite end by a end by a fastener that screws to the another threaded hole.

* * * * *